United States Patent [19]

Faltys

[11] Patent Number: 4,558,986

[45] Date of Patent: Dec. 17, 1985

[54] CONTROL MECHANISM FOR THE STATOR VANES OF AN AXIAL TURBINE DEVICE

[75] Inventor: Jan Faltys, Zurich, Switzerland

[73] Assignee: Sulzer-Escher Wyss AG, Zurich, Switzerland

[21] Appl. No.: 608,075

[22] Filed: May 7, 1984

[30] Foreign Application Priority Data

May 31, 1983 [CH] Switzerland ..... 2972/83

[51] Int. Cl.[4] ..... F04D 29/56

[52] U.S. Cl. ..... 415/150; 415/149 R; 74/104

[58] Field of Search ..... 415/149 R, 150, 159, 415/160, 148; 74/103–107

[56] References Cited

U.S. PATENT DOCUMENTS 2,575,665 11/1951 Kilpela ..... 74/107 X
3,581,806 6/1971 Neumann et al. ..... 74/105 X

FOREIGN PATENT DOCUMENTS 2235154 8/1974 Fed. Rep. of Germany .
3125639 1/1983 Fed. Rep. of Germany .
364581 9/1962 Switzerland .

*Primary Examiner*—Robert E. Garrett
*Assistant Examiner*—Joseph M. Pitko
*Attorney, Agent, or Firm*—Werner W. Kleeman

[57] ABSTRACT

A control sleeve is provided in an axial turbine device, an axial translation of which controls the stator vanes of the turbine device. In order to obtain as precise as possible a motion of the control sleeve in the axial direction without high friction forces and without the danger of jamming, a parallelogram linkage guide arrangement is provided. The parallelogram linkage guide arrangement is formed by a control yoke and control links arranged parallel thereto having pivot axes in the machine housing and further pivot axes in the control sleeve.

3 Claims, 3 Drawing Figures

CONTROL MECHANISM FOR THE STATOR VANES OF AN AXIAL TURBINE DEVICE

CROSS REFERENCE TO RELATED APPLICATION

This application is related to the commonly assigned copending U.S. application Ser. No. 388,231, filed June 14, 1982, entitled "Device for Adjusting Stator Vanes".

BACKGROUND OF THE INVENTION

The present invention broadly relates to control mechanisms and, more specifically, pertains to a new and improved construction of a control mechanism for the inlet guide vanes or stator vanes of an axial turbine device or machine having a housing and comprising an axial control sleeve arranged within the housing and translating axially for controlling the stator vanes and a control yoke for axially translating the axial control sleeve and having a pivot shaft pivotably journaled at the housing and arms pivotably journaled at the axial control sleeve.

Generally speaking, the control mechanism of the present invention is intended for the inlet guide vanes or stator vanes of an axial turbine device or machine with a control sleeve arranged in the interior of the machine housing and whose translation in the axial direction controls the inlet guide vanes or stator vanes, the axial translation of the control sleeve being actuated by a control yoke whose pivot axis is pivotably journaled in the machine housing and whose arms are pivotably journaled in the control sleeve.

Such control mechanisms are known, for instance from the Swiss Pat. No. 364,581, patented Sept. 30, 1962, or the German Patent Publication No. 3,125,639, published Jan. 13, 1983 and the cognate aforementioned copending U.S. application Ser. No. 388,231 and serve for the control or adjustment of the inlet guide vanes or stator vanes of, for instance, turbo-compressors, expansion turbines or gas turbine engines. A translation of the control sleeve in the axial direction effects a rotation of the guide vanes or stator vanes about their axis.

Due to the differential thermal expansion of the control sleeve and the machine housing, the support of the control sleeve in the machine housing is difficult to accomplish. The support of the control sleeve described in German Pat. No. 2,235,154, granted Aug. 14, 1974 and the corresponding U.S. Pat. No. 3,829,234, granted Aug. 13, 1974 by means of guide rods comprising two longitudinal positioning rods on one side and two supports permitting horizontal sliding on the opposing side represents a usable solution, particularly for relatively long control sleeves. However, in shorter control sleeves, friction forces of sometimes considerable magnitude arise when the control force does not act precisely in the center of the control sleeve, as is always more or less the case in practice.

The friction forces generated by the corresponding rotating or tipping moment in the supports become larger the shorter is the longitudinal spacing of the supports of the control sleeve. Additionally, when turning the inlet guide vanes or stator vanes, a torsional moment is applied to the control sleeve which leads to considerable sliding friction in a linear guide means of known type. These frictional forces are considerable, especially in turbo-machinery operating with hot gases, and can lead to self-locking or jamming.

As a consequence of the high temperatures, the choice of materials for the components sliding upon one another is limited and coefficients of friction of up to five times the normal value must be expected. It is therefore desirable, especially for hot gas machinery, such as turbines or expansion turbines, to have control sleeve supports offering low frictional resistance.

SUMMARY OF THE INVENTION

Therefore, with the foregoing in mind it is a primary object of the present invention to provide a new and improved construction of a control mechanism for the stator vanes of a turbine device which does not have associated with it the aforementioned drawbacks and shortcomings of the prior art constructions.

Another and more specific object of the present invention aims at providing a new and improved construction of a control mechanism of the previously mentioned type in which the control sleeve support has a substantially lower frictional resistance and self-locking or jamming is largely eliminated independent of the length of the control sleeve and without employing slide means in a simple and economical design.

Yet a further significant object of the present invention aims at providing a new and improved construction of a control mechanism of the character described which is relatively simple in construction and design, extremely economical to manufacture, highly reliable in operation, not readily subject to breakdown or malfunction and requires a minimum of maintenance and servicing.

Now in order to implement these and still further objects of the invention, which will become more readily apparent as the description proceeds, the control mechanism for the stator vanes of a turbine device or machine of the present invention is manifested by the features that control links are arranged substantially parallel to the arms of the control yoke, each control link having a first pivot axis in the housing and a second pivot axis in the axial control sleeve and the control links forming, together with the arms of the control yoke, a parallelogram linkage guide means or arrangement for the axial control sleeve in relation to the housing. That is, control links having one pivot axis provided in the machine housing and another pivot axis provided in the axial control sleeve are arranged substantially parallel to the arms of the control yoke, the control links and the arms of the control yoke forming a four-bar or parallelogram linkage guide means or arrangement for the axial control sleeve in relation to the machine housing.

An extremely precise translatory motion of the control sleeve with a minimum of friction is obtained by this parallelogram guide means and a tipping or canting of the control sleeve is largely eliminated and a self-locking or jamming is prevented.

It is particularly advantageous for the engaging points or points of action of the control force, i.e. the pivot points of the control yoke arms and of the control links at the control sleeve, to be arranged at the height of the axis of the turbine device or machine and therefore the tipping or canting moment held as low as possible.

It is of particular advantage in the solution according to the invention for the control yoke to have a sufficient rigidity, as is described, for example, in the aforementioned German Patent Publication No. 3,125,639 to which reference may be readily had and the disclosure of which is incorporated herein by reference.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
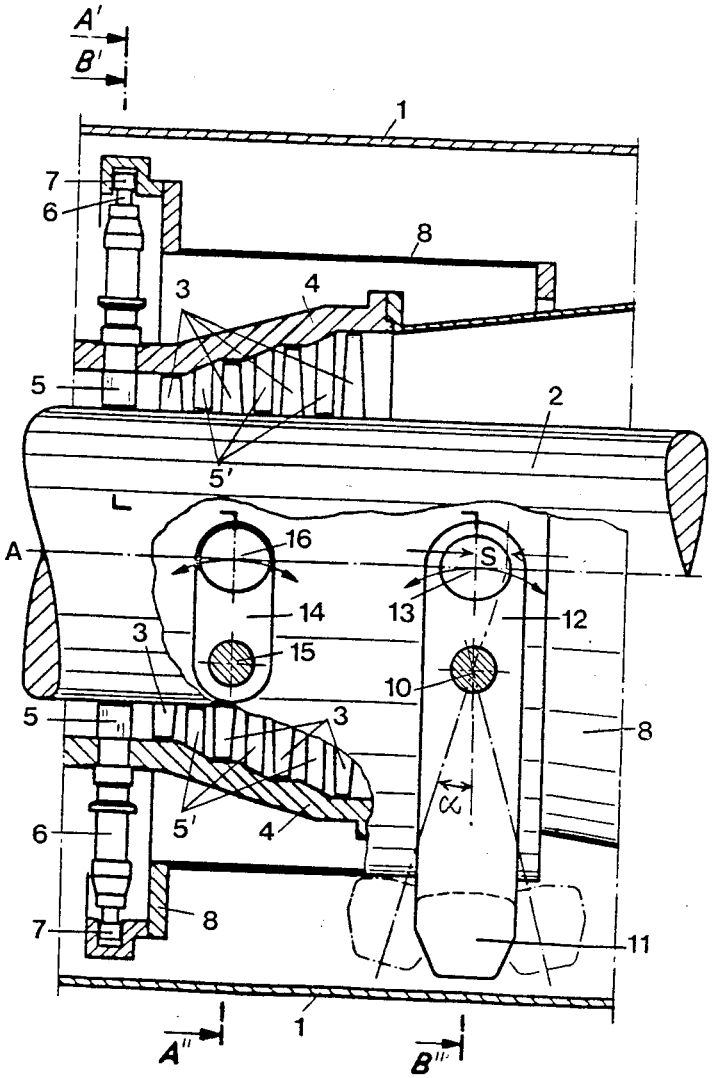
FIG. 1 schematically shows an axial section of a portion of an axial compressor having a control mechanism for a control sleeve and constructed according to the invention.

Describing now the drawings, it is to be understood that to simplify the showing of the drawings only enough of the structure of the control mechanism has been illustrated therein as is needed to enable one skilled in the art to readily understand the underlying principles and concepts of this invention. The illustrated exemplary embodiment of the control mechanism for the inlet guide vanes or stator vanes of an axial turbine device or machine is shown in FIG. 1 in relation to a housing 1 of an axial compressor in which a rotor 2 is concentrically arranged and provided with rotor blades 3 on its exterior. The rotor 2 is concentrically surrounded by a stationary stator vane support housing or compressor casing 4 in which adjustable, i.e. journaled to rotate about a control axis, inlet guide vanes or stator vanes 5 as well as further fixed guide vanes or stator vanes 5' are inserted.

The inlet guide vanes or stator vanes 5 of the outermost or forward stator vane ring are provided with control levers 6 for their adjustment or control. The control levers 6 engage at an annular groove or channel 7 in an axially translatable control sleeve 8. When this control sleeve 8 is translated or displaced in the axial direction, the control levers 6 are pivoted and the guide vanes or stator vanes 5 are correspondingly rotated about their axes. The further guide vanes or stator vanes 5' may be either fixedly mounted or also adjustable in a manner analogous to the inlet guide vanes or stator vanes 5.

The axial translation of the control sleeve 8 necessary for this purpose is effected by means of a pivotable control yoke or adjustment fork 11 journaled in the machine housing 1 to pivot about a pivot axis or axes 10. The arms 12 of this control yoke 11 engage at pivot points 13 in the control sleeve 8 such that a pivoting motion of the control yoke 11 through an angle $\alpha$ translates the control sleeve 8 through a distance S in the axial direction.

It is advantageous for the pivot axis 13 of the control yoke arms 12 to be chosen such that they lie approximately at the height of the longitudinal axis A of the turbine device or machine, so that the control forces act at the center of a control cylinder defined by the axial control sleeve 8 and a tipping or canting moment is avoided to the extent possible.

Control links 14 are provided substantially parallel to the arms 12 of the control yoke 11 but spaced at a certain distance therefrom in the axial direction and are pivotably journaled in the machine housing 1 at both sides in pivot points of a pivot axis 15. The control links 14 comprise further pivot points 16 at their opposite ends on both sides which engage the control sleeve 8. The distances or spacings between the pivot axes or pivot shafts 10 and 13 as well as between the pivot axes or pivot shafts 15 and 16, on the one hand, and between the pivot axes 13 and 16 as well as the pivot axes 10 and 15 on the other hand, are chosen to be as precisely equal as possible so that as precise as possible a parallelogram linkage guide means or arrangement is formed, guaranteeing an accurate guidance of the control sleeve 8 in the axial direction with a particularly simple and economical design and with the lowest possible friction forces.

It is advantageous for the pivot axis or pivot shaft 16 of the control links 14 to have about the same distance or spacing from the axis A as does the pivot axis 13 the control yoke 11, i.e. for both pivot axes 13 and 16 to be chosen at the height of the axis of the turbine device or machine. In this case, the long sides 13–16 and 10–15 of the parallelogram 1 are essentially parallel to the axis A. However, a solution with a skew parallelogram is also possible in which the pivot axes 13 and 16 or 10 and 15 have different relations to the axis A, that is the long sides 13–16 and 10–15 of the parallelogram run at an angle to the longitudinal axis A of the turbine device or machine.

Figure 2:
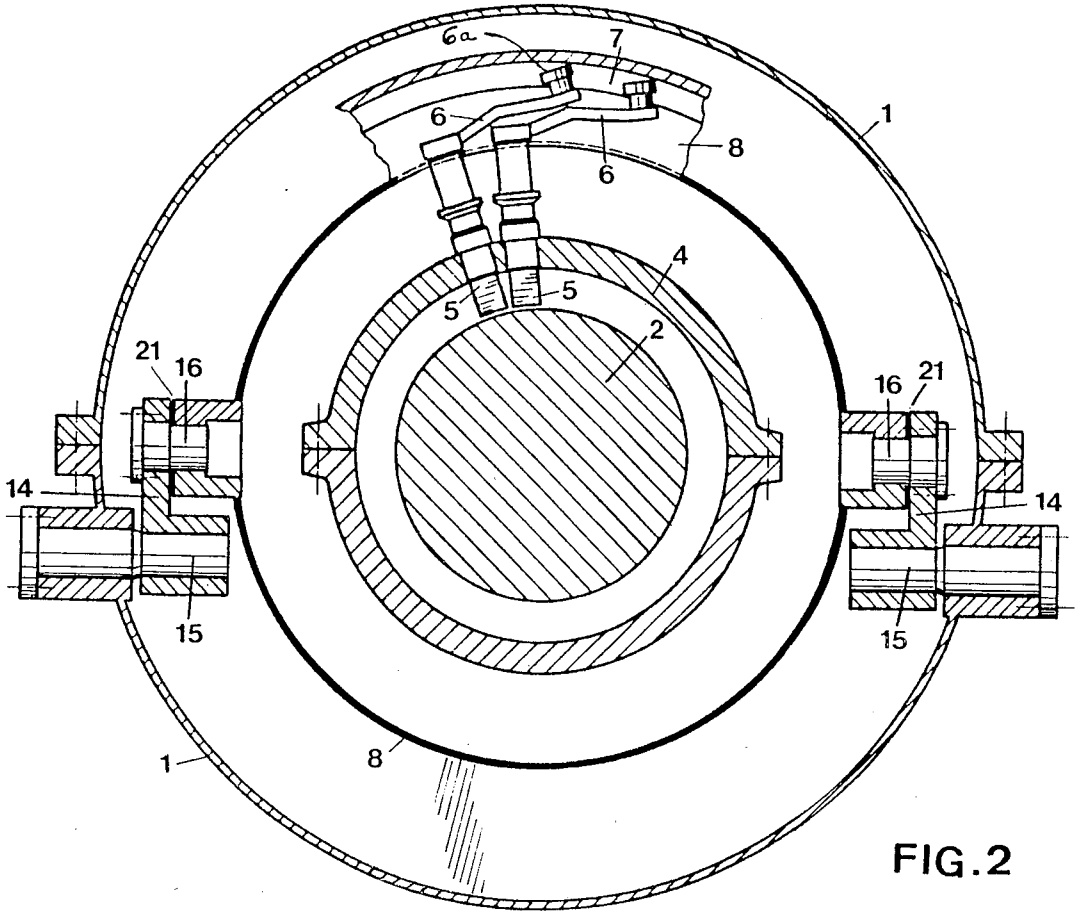
FIG. 2 schematically shows a section through the axial compressor of FIG. 1 taken along the line A'–A"

When the control links 14 perform the pivoting motion about the pivot point 15 and the control yoke arms 12 perform the pivoting motion about the pivot point 10, the other pivot points 16 and 13 of the control cylinder or sleeve 8 each describe a segment of a circular arc, only the axial component of which serves for controlling the guide vanes or stator vanes 5. The component vertical to the axis A, which in the usual control displacements is relatively small, can be readily accommodated by a sufficient radial play or clearance of the slide blocks 6a (FIG. 2) of the control levers 6 in the annular grooves or channels 7.

Since a considerable temperature gradient between the control sleeve 8 and the machine housing 1 can arise during operation of the turbine device or machine described, it is advantageous to provide a certain radial play or clearance 21 of the control sleeve 8 in the pivot axis 13 and 16 transverse to the longitudinal axis A to compensate for the differential thermal expansion. Supplementary longitudinal stops can be provided to avoid a swimming motion of the control sleeve 8.

Figure 3:
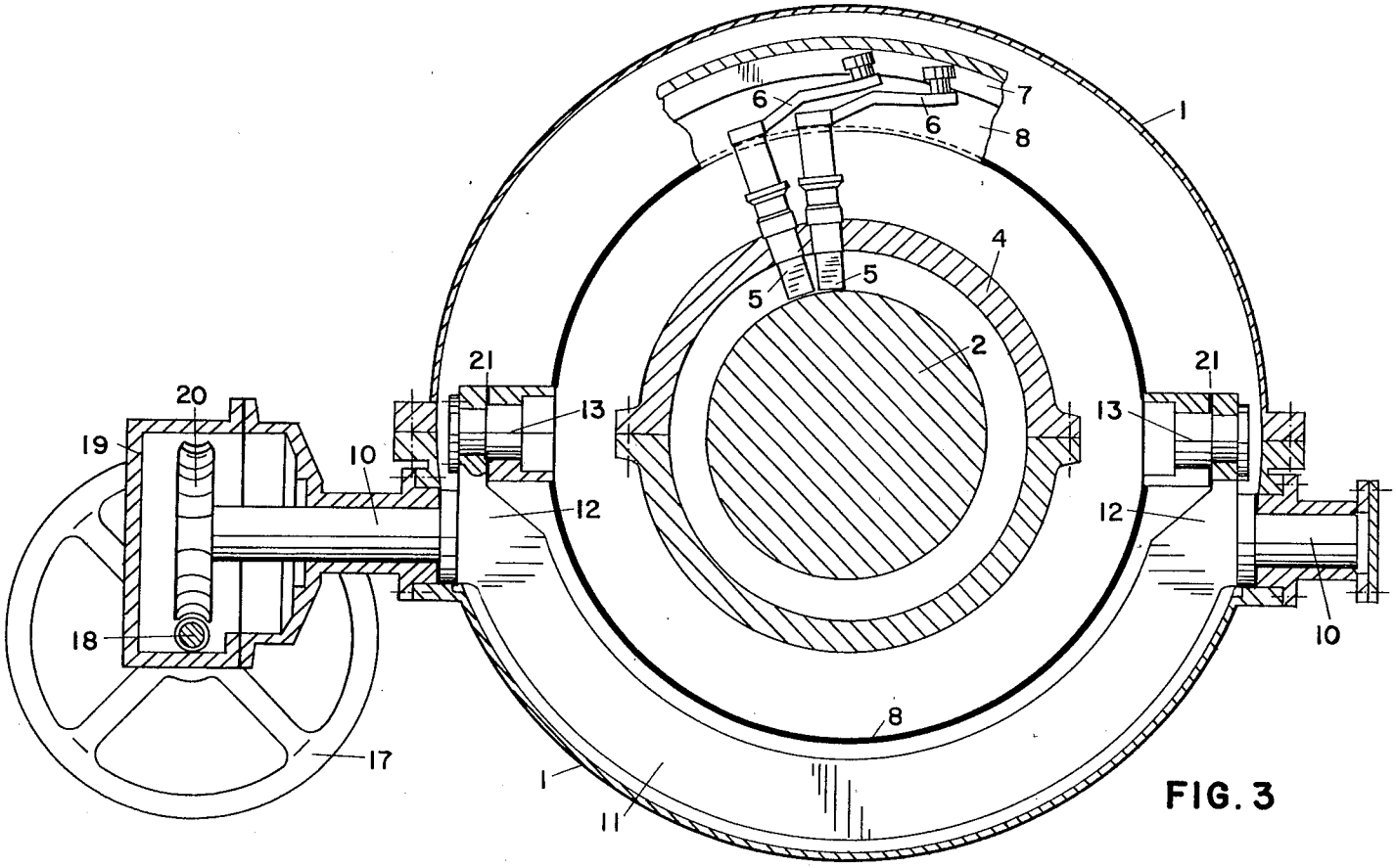
FIG. 3 schematically shows a section through the axial compressor of FIG. 1 at right angles to the axis in the plane of the line B'–B".

The drive means for the control yoke 11 or equivalent structure can be manual or can be powered and can operate through a control or regulating mechanism to engage the control yoke 11 at a suitable position. In the example shown in FIG. 3, a hand wheel 17 is provided for this purpose which acts through a worm gear 18 in a gearbox 19 upon a worm wheel 20 which is anchored on the extended end of one of the pivot shafts 10. The drive can, however, also be effected by other means and engage the control yoke 11 at another position.

Further variations are possible within the conceptual framework and teachings of the present invention. For instance, the connection points of the control yoke with the machine housing can also be provided at the outermost ends of the arms of the control yoke instead of between the apex of the control yoke and the connection points with the control sleeve. The outermost ends of the control yoke can also be connected with one another for improving stability and rigidity so that the yoke becomes a continuous ring. The control links can also be connected to one another at their ends and therefore also form a yoke or a ring.

Instead of the control mechanism described with annular grooves or channels and pivotable levers, other control or adjustment mechanisms can also be provided which operate in any desired manner in combination with a sleeve translatable in the axial direction. The control of the yoke can, for instance, also be effected by a linear stepping motor acting at the apex of the yoke instead of at the pivot points.

While there are shown and described present preferred embodiments of the invention, it is to be distinctly understood that the invention is not limited thereto, but may be otherwise variously embodied and practiced within the scope of the following claims. Accordingly,

What I claim is:

1. A control mechanism for the stator vanes of an axial turbine device having a housing, comprising:

an axial control sleeve arranged within said housing;

said axial control sleeve translating axially for controlling the stator vanes;

a control yoke for axially translating the axial control sleeve;

said control yoke having a pivot shaft pivotably journaled at the housing and arms journaled at the axial control sleeve for pivoting about a pivot axis;

said pivot shaft and said pivot axis of each one of said arms being arranged at a predetermined distance from each other;

control links, each of which are arranged essentially parallel to an associated one of said arms of the control yoke;

each of said control links having a first pivot axis in the housing and a second pivot axis in the axial control sleeve;

said first pivot axis and said second pivot axis of each of said control links having a predetermined distance substantially equal to said predetermined distance between said pivot shaft and said pivot axis of said arm; and each of the control links forming, together with said associated arm of the control yoke, two arms of a parallelogram linkage for axially guiding the axis control sleeve during its translation in relation to the housing.

2. The control mechanism as defined in claim 1, wherein:

said turbine device has an axis;

means for pivotably journaling said arms of said control yoke at said axial control sleeve on a pivot axis; and said pivot axis of the arms of the control yoke and said second pivot axis of said control link being arranged at least approximately at the height of said axis of the turbine device.

3. The control mechanism as defined in claim 1, further including:

means for accommodating motion in a direction essentially radial to said axis of said turbine device at said pivot axis of said control yoke and at said second pivot axis of said control links in said axial control sleeve.

* * * * *

UNITED STATES PATENT AND TRADEMARK OFFICE

CERTIFICATE OF CORRECTION

PATENT NO. : 4,558,986

DATED : December 17, 1985

INVENTOR(S) : Jan Faltys

It is certified that error appears in the above—identified patent and that said Letters Patent is hereby corrected as shown below:

Column 6, line 14, at the end of the line please delete "axis" and insert --axial--

Signed and Sealed this

*Twenty-seventh* Day of *May 1986*

[SEAL]

*Attest:*

DONALD J. QUIGG

*Attesting Officer*

*Commissioner of Patents and Trademarks*